US005110107A

United States Patent [19]

Bieber

[11] Patent Number: 5,110,107

[45] Date of Patent: May 5, 1992

[54] SHEET MATERIAL FEEDER

[75] Inventor: Thomas E. Bieber, Coplay, Pa.

[73] Assignee: Bell & Howell Phillipsburg Co., Allentown, Pa.

[21] Appl. No.: 680,081

[22] Filed: Apr. 3, 1991

Related U.S. Application Data

[63] Continuation of Ser. No. 524,563, May 17, 1990.

[51] Int. Cl.[5] ..... B65H 3/04

[52] U.S. Cl. ..... 271/35; 271/122; 271/273

[58] Field of Search ..... 271/161

[56] References Cited

U.S. PATENT DOCUMENTS 4,059,262 11/1977 Fujimato ..... 271/35

4,607,832 8/1986 Abe ..... 271/10

FOREIGN PATENT DOCUMENTS 475056 7/1951 Canada ..... 271/272

74777 2/1945 Czechoslovakia ..... 271/272

*Primary Examiner*—H. Grant Skaggs

*Assistant Examiner*—Carol Lynn Druzbick

*Attorney, Agent, or Firm*—Griffin Branigan & Butler

[57] ABSTRACT

A sheet material feeder for high speed singulating and seriatim feeding of sheet material articles from the bottom of a stack disposed in a hopper comprises apparatus for feeding sheets from the stack and a restrainer device for restraining all but the lowermorst sheet from being fed from the hopper by virture of transversely corrugating the sheet while it is fed from the hopper and passed through the restrainer.

23 Claims, 5 Drawing Sheets

SHEET MATERIAL FEEDER

This is a continuation of application Ser. No. 07/524,563, filed May 17, 1990.

BACKGROUND OF THE INVENTION

1. Field of the Invention

This invention relates generally to sheet material article feeders, and more specifically to feeders which feed one article at a time from the bottom of a stack of sheet articles.

2. Prior Art and Other Considerations

Sheet feeders which feed from the bottom of a stack often employ endless feed belts having a feeding surface contacting the bottom face of the lowermost sheet and thereby driving the sheet substantially in and along its plane from beneath the stack. Such sheet article feeders commonly employ a restraining structure or mechanism to block and prevent all but the lowermost sheet from being passed therethrough.

Difficulties encountered with conventional feeders have included misfeeds in form of double or multiple sheets being fed or, alternately, absences of a sheet when it should have been fed. These difficulties are experienced particularly in high speed operation and when sheet articles of differing properties are handled. For instance, different material thickness, stiffness, surface friction, and different sheet article sizes have critically affected reliable operation of such feeders in the past. Sensitive mechanical adjustment has been generally required to particular sheet article properties and sizes to assure reliable operation, and even relatively slight changes in such properties and/or sizes necessitated readjustment of the device. Consequently, such feeders have also been unable to reliably handle a mix of sheet articles.

Prior art feeders singulating and feeding individual sheets from the bottom of a stack have employed a variety of restrainer or retarder mechanism in order to prevent all but the lowermost sheet to be fed. Such feeders are, for example, shown in the following U.S. Patents.

Rouan (U.S. Pat. No. 2,273,288) discloses an adjustable separator for stripping letters from the bottom of a stack. Adjustment facilitates substantially constant tension whilst the separator yields as letters of varying thickness pass therebeneath. Kramell et al (U.S. Pat. No. 3,895,791) discloses a bottom sheet feeder comprising a separation belt and a retard pad that is biased against the belt to bow the belt down. Strobel (U.S. Pat. No. 3,934,869) shows a sheet separating and feeding apparatus including a feed belt adapted for frictional engagement with retard means 38. Generally similar devices are also shown by Godlewski and by Larson in U.S. Pat. Nos. 4,666,140 and 4,555,103, respectively.

Imposition of transverse bowing onto sheet materials for various purposes during sheet handling and transporting is shown in prior art, for instance, by U.S. Pat. No. 4,744,555 to Naramore et al, U.S. Pat. No. 4,663,527 to Koyama et al, and U.S. Pat. No. 2,157,228 to Buccicione et al.

The sheet article feeder of the present invention particularly obviates difficulties of the aforementioned kind and provides reliable singulating and feeding of sheet material from the bottom of a stack in high speed operation and for sheet material that can vary significantly in properties as well as size. The sheet article feeder tolerates substantial misalignments of individual articles (including skew) without misfeeding and without the need for adjustments to accommodate different and mixed different sheet materials in uninterrupted operation. These characteristics provide significant operating and cost advantages not heretofore provided by prior art devices.

Accordingly, an important overall feature of the invention is the provision of an improved sheet material feeder and an improved method of singulating and feeding thereby sheet material of different and mixed properties and sizes from the bottom of a stack disposed in a hopper, the feeder including means for urging sheets in the stack toward a singulating exit region and means for feeding a lowermost sheet from the stack through a restrainer device, wherein the restrainer device restrains all but the lowermost sheet from feeding out from the hopper by virtue of transversely resiliently corrugating the lowermost sheet while it passes through the restrainer device.

SUMMARY OF THE INVENTION

In accordance with principles of the present invention, there is provided an improved sheet material feeder and an improved method of singulating and feeding thereby sheet material of different and mixed properties and sizes from the bottom of a stack disposed in a hopper, the feeder including means for urging sheets in the stack toward a singulating exit region and means for feeding a lowermost sheet from the stack through a restrainer device, wherein the restrainer device restrains all but the lowermost sheet from feeding out from the hopper by virtue of transversely resiliently corrugating the lowermost sheet while it passes through the restrainer device.

The restrainer device comprises a resilient member supported along a portion of an inner surface thereof on a support member and having an unsupported lateral overhang extending beyond the support member. Facing the outer surface of the resilient member in the region of the lateral overhang is an urging surface of a guide member. The spacing between the urging surface and the surface of the support member in a general direction normal to these surfaces is set to be the sum of the thickness of the resilient member between its inner and outer surfaces plus at most a distance that is less than the thickness of the thinnest sheet material operatively handled.

In operation, a lowermost sheet is fed from the stack between the outer surface of the resilient member and the urging surface and, consequently, resiliently deflects the lateral overhang portion of the resilient member in order to pass through. As a result, at least a portion of the lowermost sheet is transversely resiliently corrugated or bowed while passing through the restrainer device. Effects of this corrugation, particularly lifting effects on sheets overlaying the lowermost sheet and especially in leading edge regions of these sheets, assist and enhance restraining effects of the restraining device to reliably avoid misfeeds of sheets, even if sheets of different and mixed properties and sizes are fed.

The sheet material feeder of the invention is particularly useful in feeding of paper sheet material, such as given by individual paper sheets (plain or folded), signatures, envelopes, brochures, booklets, and the like. The feeder has been found rather advantageous also in feeding of cards and card booklets, cardboard, and it can handle still more rigid sheet materials, for instance plastic and metal sheets, and the like.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
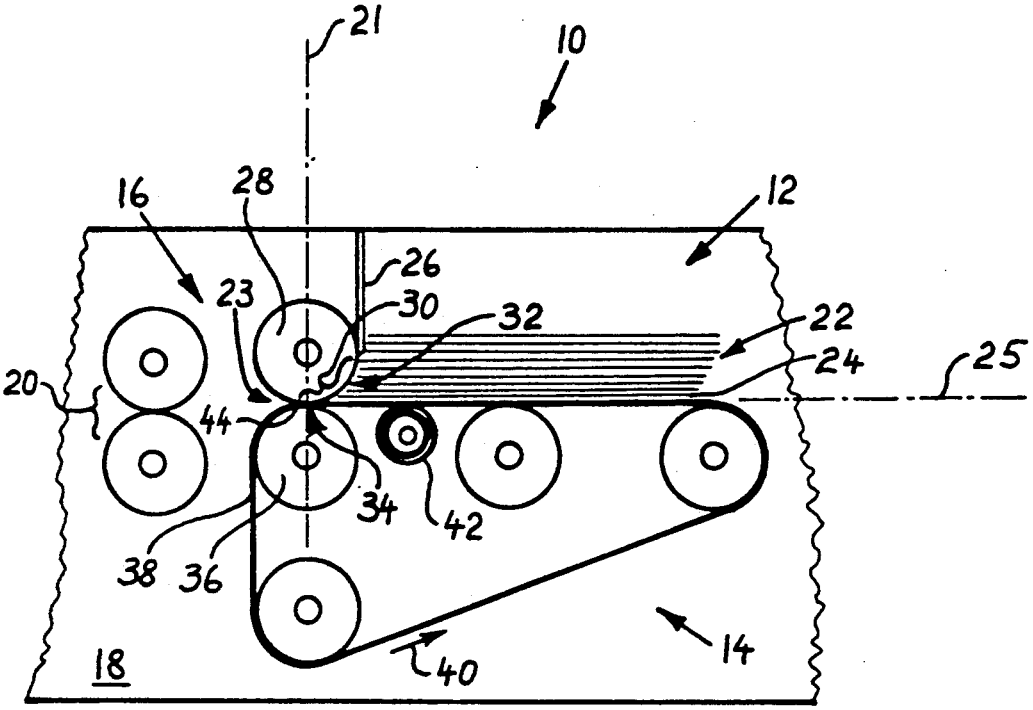
FIG. 1 is a schematic side view of an embodiment of a sheet material feeder according to principles of the present invention.

Referring now to FIG. 1, there is depicted a sheet material feeder 10 comprising a hopper 12, a belt drive mechanism 14, a restraining mechanism 16, and a fragmentally indicated mounting structure 18. Additionally shown here is driven pair of nip rollers 20 for farther transporting of sheets delivered thereto from feeder 10. Further defined here is a singulating plane 21 which is oriented substantially perpendicularly with respect to the bottom plane of hopper 12 and orthogonally to the depiction plane of FIG. 1, and which extends generally through the middle of restraining mechanism 16.

Hopper 12 holds a sheet stack 22 including a lowermost sheet 24. A sheet feeding plane 25 is indicated on the right side of the depiction. A singulating exit region 23 is designated as the general sheet exit region (at the left side of hopper 12) about in the middle of the restraining mechanism 16 in the region of singulating plane 21. Lowermost sheet 24 is substantially disposed in sheet feeding plane 25. Disposed at the front end (left end) of hopper 12 is a barrier wall 26 and, further frontwardly, the restraining mechanism 16 comprising a stationary guide member 28 (here shown in form of a cylindrical body). Guide member 28 includes an urging surface 30 represented by a downwardly and rightwardly facing portion of the guide member's periphery. The rightwardly facing portion is designated as a first portion 32 and the downwardly facing portion is designated as a second portion 34.

Restraining mechanism 16 further comprises a support member 36 and a resilient member 38 supported thereon. Support member 36 and resilient member 38 are shown here in form of a revolving pulley and an endless belt, respectively, both also comprised in belt drive mechanism 14. Belt drive mechanism 14 further includes a plurality of pulleys carrying resilient member 38 (endless flat belt). At least one of the pulleys is motor-driven so that resilient member 38 moves in direction of arrow 40. Also comprised in belt drive mechanism 14 is an adjustable idler roller 42 that is borne freely revolvably upon an eccentrically mounted boss. Roller 42 can be adjusted to lift or lower the thereupon carried portion of the endless belt by angular adjustment of the eccentric boss.

Figure 2:
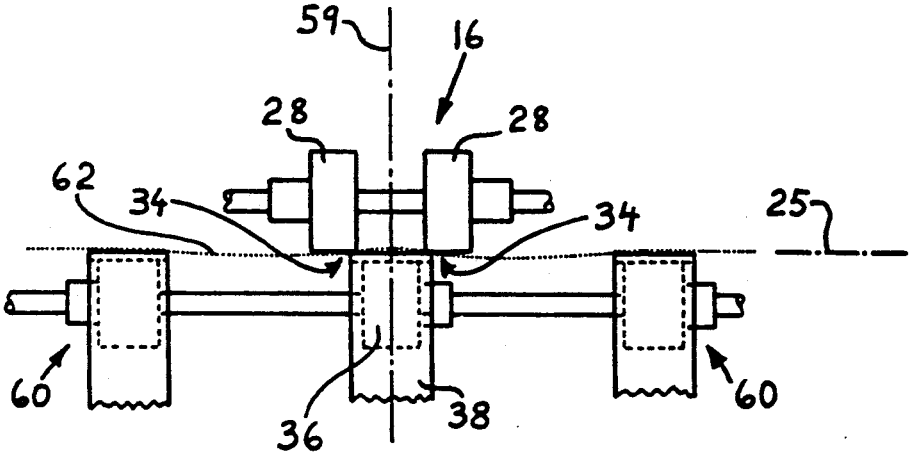
FIG. 2 is a schematic frontal view of a portion of the embodiment shown in FIG. 1.
Figure 3:
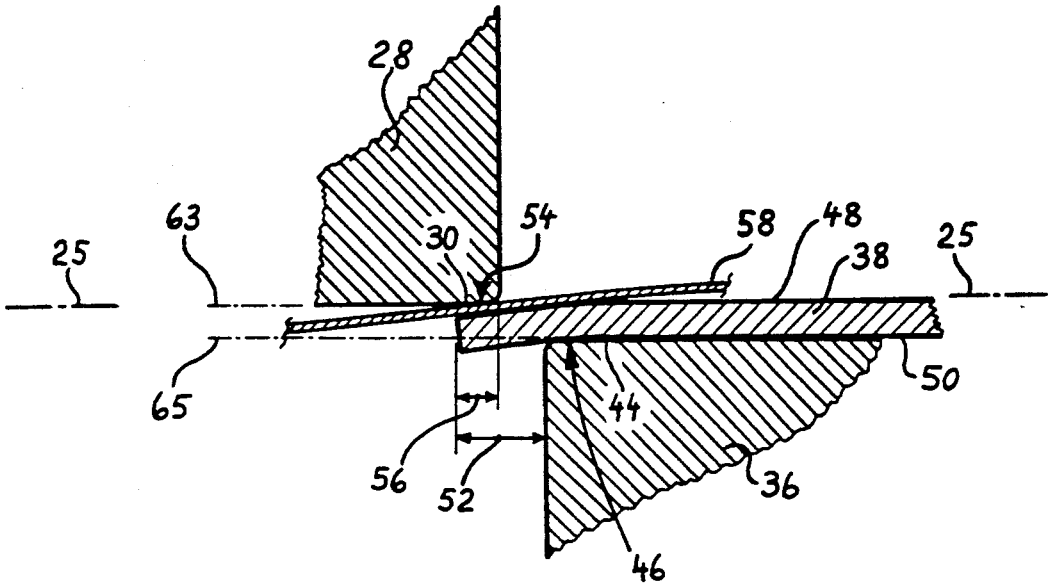
FIG. 3 is a schematic sectioned enlargement of a fragmental portion of the view depicted in FIG. 2 showing further details.

As will be more clearly apparent in view of FIGS. 2 and 3, at least one guide member 28 is disposed laterally in a position so as to slightly overlap resilient member 38 in a region of a lateral overhang thereof over support member 36. FIG. 3 represents an enlarged portion of a section substantially through singulating plane 21.

Referring now more particularly also to FIGS. 2 and 3, support member 36 includes a support surface 44 that has a supporting edge region 46 at least on one side thereof for supporting resilient member 38. Resilient member 38 has an outer surface 48 and an inner surface 50. Inner surface contacts support surface 44 at least in a supporting edge region 46. Resilient member 38 overhangs laterally over the side of support member 36 by a lateral overhang 52. Second portion 34 of urging surface 30 (of guide member 28) has an urging edge region 54 on one side thereof. In urging edge region 54, second portion 34 of urging surface 30 faces outer surface 48, thusly forming an overlap 56 over a portion of the lateral overhang 52 of resilient member 38.

Also indicated in FIG. 3 is a portion of a sheet 58 as it is being fed between guide member 28 and resilient member 38 through restraining mechanism 16.

Particularly with reference to FIG. 2, a pair of guide members 28 is shown, each guide member being disposed symmetrically on lateral sides of resilient member 38 in mirror-image manner mirrored with respect to a center plane 59. Further, additional belt drive means 60 to support sheets fed by the feeder are indicated. It should be noted that additional belt drive means 60 can be replaced by low-friction stationary guide surfaces for lateral support of fed sheets. A typical sheet 62, fed between guide members 28 and resilient member 38, is indicated by a dotted line. It will be appreciated, also in view of FIG. 3, that sheets are slightly transversely resiliently corrugated, bowed, or waved slightly out of the sheet feeding plane 25 while being fed through restraining mechanism 16, as indicated here by typical sheet 62.

As illustrated in FIGS. 1-3, resilient member 38 can be a plain endless flat belt or a flat timing belt having teeth along its inner surface to engage corresponding grooves or teeth in the periphery of the belt-carrying pulleys. Conventional belts having appropriate resiliently elastic properties have been found adequate for purposes of this invention. Although it has been found that particular surface properties of guide member 28 in its urging surface 30 have little, if any, influence on proper operation of the feeder, a preferred material for surface 30 is polyurethane of 83 Shore A Durometer hardness.

In operation of a sheet material feeder as particularly depicted in FIGS. 1 and 2, sheet stack 22 is urged toward singulating plane 21 by the feeding motion of resilient member 38 (being a driven endless belt) upon which stack 22 is at least partially supported in hopper 22. Leading edges of all sheets but the lowermost sheet 24 impact on barrier wall 26 or on guide member 28 and are stopped thereby. The lowermost sheet 24 continues to be fed by resilient member 38 into the singulating exit region 23 between guide member 28 and resilient member 38. As lowermost sheet 24 is nipped therebetween, it is slightly transversely resiliently corrugated at least in the region of singulating exit region 23 by virtue of the structural relationships between members 28 and 38 (as particularly also illustrated in FIG. 3). Hence, the next one or two or more sheets in the stack have their leading ends slightly lifted up. Moreover, the lowermost sheet is partially separated by the corrugation from the next sheet, which results in a significant reduction of friction therebetween. These effects reliably enhance avoidance of multiple sheet misfeeds.

The corrugated sheet is now delivered to farther equipment, for instance via nip rollers 20. A thusly delivered sheet can be sensed in order to temporarily stop belt drive mechanism 14 until the delivered sheet has passed on some desired distance, when the belt drive mechanism is again energized to feed the next sheet. Spacing between successively delivered sheets can be thusly changed as desired.

The sheet corrugating operation can be best appreciated in view of FIG. 3. As a lowermost sheet is fed from the bottom of sheet stack 22 upon resilient member 38, the leading edge of the sheet is forced under guide member 28 and the sheet slides therealong while it is fed. The spacing provided between supporting edge region 46 (of support member 36) and urging edge region 54 (of guide member 28) is such that a sheet fed upon resilient member 38 resiliently deflects lateral overhang 52 while the sheet is slightly squeezed or nipped in the region of overlap 56 between urging edge region 54 and the portion of the outer surface 48 (of resilient member 38) disposed in a deflected portion of lateral overhang 52.

In this respect, there is defined: a first plane 63 that is substantially parallel to sheet feeding plane 25 and that is tangent to urging surface 30 in the region of singulating plane 21; and, a second plane 65 that is parallel to first plane 63 and that is tangent to the support surface 44 at least in the supporting edge region 46 in the region of singulating plane 21. First and second planes are preferably spaced apart by a distance that is less than the sum of the thickness of the resilient member 38 plus the smallest thickness of sheet material operatively handled.

For example, a gap of about one thousandth of an inch between the outer surface 48 (of a relaxed resilient member 38 in absence of a sheet) facilitates reliable feeding and singulating of sheets with thicknesses in the approximate range of about 0.002 to 0.018 inches and thicker without readjustment. This gap can be further reduced to become an interference; for instance, an interference (negative gap) of 0.010 inches will still provide for reliable feeding of sheets in the aforementioned thicknesses. Such an interference has been found advantageous, but not essential, when sheet material of particularly unusual or troublesome surface characteristics is used. In respect to larger sheet material thicknesses, for instance those considerably in excess of 0.018 inches, it has been found that a gap of 0.010 inches reliably handles most customary sheet materials. A preferred length for overhang 52 to handle most customary sheet materials is in a 20 the range of about ⅛ of an inch or more, and substantially no less than about 1/16 of an inch. It will be appreciated that overlap 56 is always less than overhang 52. A preferred length for lateral overlap 56, also to handle most customary sheet materials, is about 1/16 of an inch or more. Moreover, reliable handling of sheet materials in thicknesses approaching ¼ of an inch, for instance as given by coupon books and the like, is facilitated by the sheet material feeder according to the principles of the invention by appropriate gap adjustment and by provision of a correspondingly longer lateral overhang 52.

Hopper 12, shown in FIG. 1, need not be oriented horizontally but can be tilted downwardly toward singulating plane 21 (from right to left). It has been found that a tilt of up to about 30 degrees does not significantly affect operation. Moreover, operation at a greater tilt is feasible by appropriate adjustments of structural component relationships.

In respect to the shape of urging surface 30 in transversal direction, it should be noted that other than planar shapes can be employed, such as for instance convex, concave, stepped or undercut, grooved, and the like. Similarly, support surface 44 can be in a variety of shapes. In this respect, for instance when support member 36 is a pulley, it can have a cylindrical shape, a crowned barrel shape, and the like.

In regard to the relative locations of guide member 28 and support member 36, whereas FIG. 1 illustrates these two components one above the other generally disposed in singulating plane 21, guide member 28 (together with barrier wall 26) can be located some small distance upstream so that it is no longer disposed directly above the center line of support member 36.

Figure 4:
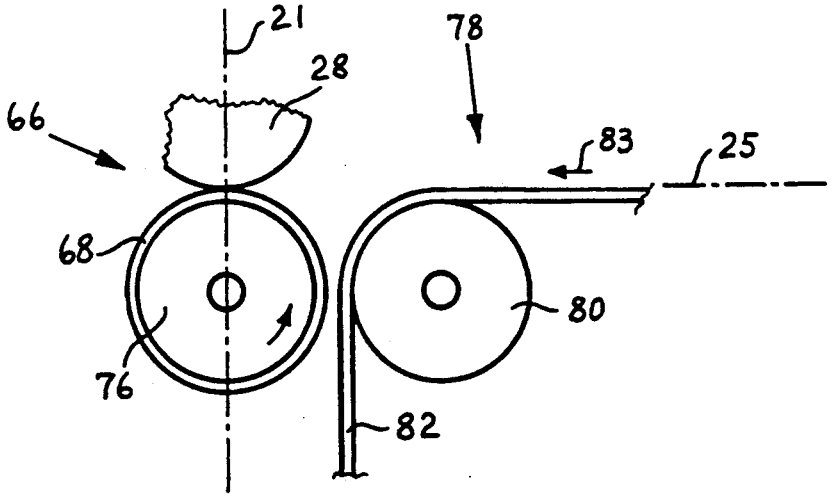
FIG. 4 is a schematic side view showing a portion of a feeder in another embodiment of the invention.

Referring now to FIG. 4, another embodiment of the invention is illustrated here by the portion that differs from the embodiment depicted in FIGS. 1 and 2. In particular, a restraining mechanism 66 is provided comprising guide member 28 (the same or similar as shown in FIGS. 1-3) and a resilient member 68 in form of a sleeve borne about the periphery of a support member 76, wherein support member 76 is a driven roller. Support member 76 is substantially similar to support member 36 of FIGS. 1-3. The portion of a belt drive mechanism 78 disposed in the vicinity of support member 76 is shown here to include a revolving pulley 80 and an endless flat belt 82 that is driven in direction of arrow 83. When viewed in conjunction with FIG. 1, it will be apparent that belt drive mechanism 78 differs only insignificantly from belt drive mechanism 14 (FIG. 1).

In particular, belt drive mechanism 78 now extends leftwardly for a shorter distance and does not include a portion of restraining mechanism 66 (16 in FIG. 1). Sheets are fed (substantially in sheet feeding plane 25) from the hopper upon the top of endless flat belt 82 to and through the nip between resilient member 68 and guide member 28. Support member 76 is driven to provide the same outer surface speed for belt 82 and resilient member 68.

With respect to further details of structure and operation, the embodiment indicated in FIG. 4 is similar or identical to the embodiment illustrated in and described in conjunction with FIGS. 1-3. Particularly also FIG. 3 and the description presented therewith is equally applicable.

Figure 5A:
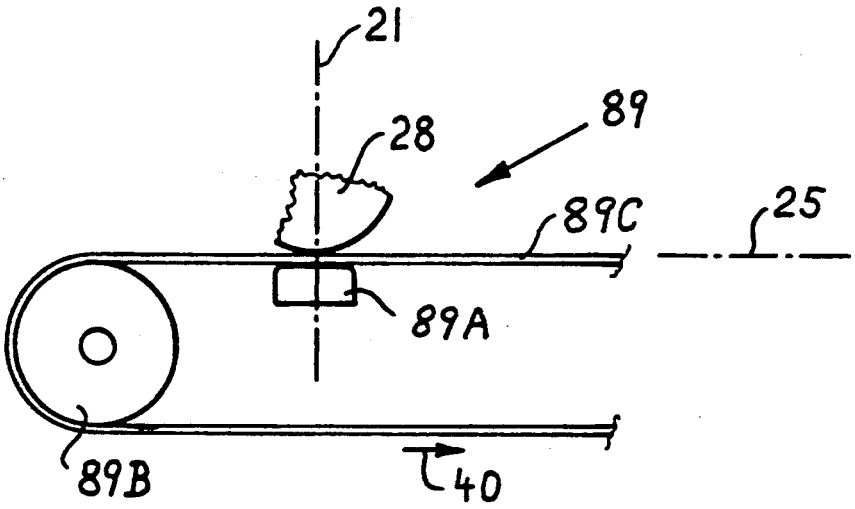
FIG. 5A is a schematic side view showing a portion of a feeder in a yet further embodiment of the invention.
Figure 5:
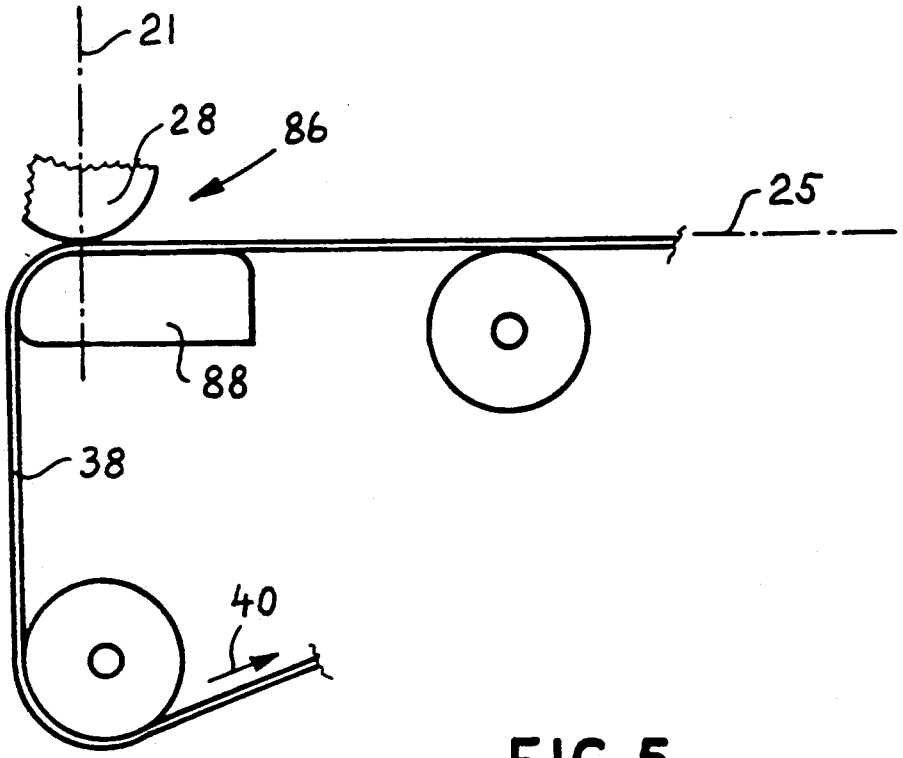
FIG. 5 is a schematic side view showing a portion of a feeder in a further embodiment of the invention.

Referring now to FIG. 5, a further embodiment of the invention is illustrated here by the portion that differs from the embodiment depicted in FIGS. 1 and 2. In particular, a restraining mechanism 86 is provided comprising guide member 28 (the same or similar as shown in FIGS. 1-3) and resilient member 38 substantially the same as in FIGS. 1-3. The only significantly different component being a support member 88 in form of a stationary slide block adapted to facilitate sliding thereover of resilient member 38 in the driven direction indicated by arrow 40. The slide block of support member 88 is made preferably of a low friction material, such as for instance given by Delrin, Teflon, and the like, but can be made of other materials too. Support member 88 in sectional view of its upper portion (together with guide member 28 and resilient member 38) is substantially identical to support member 36 in the depiction in FIG. 3, and the description presented in conjunction therewith is equally applicable.

Referring now to FIG. 5A, a further embodiment is illustrated in regard to aspects differing from those shown in FIG. 5. A restraining mechanism 89 is provided comprising guide member 28, support member 89A, and resilient member 89C (in form of an endless belt). Resilient member 89C is carried by pulley 89B (and at least one other pulley not shown here) and is driven in the direction of arrow 40. Support member 89A is provided in the form of a stationary slide block adapted to facilitate sliding thereover of resilient member 89C. In all other respects and in function, restraining mechanism 89 is similar or identical to the mechanism shown in FIG. 5, and the description given in conjunction therewith is equally applicable.

With respect to further details of structure and operation, the embodiments indicated in FIGS. 5 and 5A are similar or identical to the embodiment illustrated in and described in conjunction with FIGS. 1-3.

Figure 6:
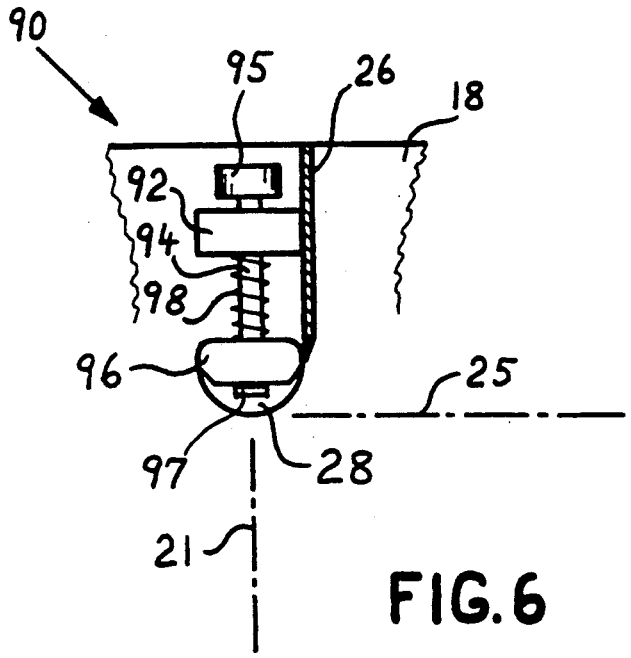
FIG. 6 is a schematic side view showing detail aspects of a restrainer mounting according to the invention; and, FIGS. 7 and 8 are schematic front views illustrating portions of the invention in yet further embodiments of the invention.

Referring now to FIG. 6, a mounting arrangement 90 for mounting guide member 28 to mounting structure 18 of a sheet material feeder according to the invention includes a bracket 92, means for adjusting the vertical position of guide member 28, and means for spring-loading guide member 28 downwardly. As indicated, the arrangement is disposed generally in singulating plane 21 having the lowermost portion of guide member 28 disposed in the general proximity of sheet feeding plane 25. Bracket 92 is rigidly mounted to structure 18 (and can be also or alternately attached to barrier wall 26) by here not shown conventional means.

A boss 94 having an adjustment knob 95 extends vertically adjustably (for instance screw-threadedly) through a hole in bracket 92. A block 96 is borne on boss 94 vertically slideably and is irrotationally guided. A stop collar 97 is affixed to the lower end of boss 94. A compression spring 98 is threaded over boss 94 and extends between bracket 92 and block 96 in preloaded manner so that block 96 is forced downwardly against stop collar 97. Guide member 28 is attached to block 96. The vertical position of block 96 and therewith of guide member 28 can be adjusted, for instance, by turning of knob 95.

It will be apparent that guide member 28 can move upwardly from an adjusted position against the spring-loading of spring 98. This latter effect is utilized, for example, when a thick sheet material article is fed beneath guide member 28 such that the resilient elastic properties of resilient member 38 in the arrangements of the restraining mechanism for instance (as shown in FIGS. 1-5) are inadequate to provide commensurate resilient give. It has been found, however, that spring-loading by spring 98 is not required for proper normal operation of the feeder when the properties of fed sheet materials (for instance thicknesses) do not grossly vary during a particular run. Therefore, in such an embodiment, spring 98 is omitted and guide member 28 is adjusted by adjustment means (knob 95, boss 94) to a substantially fixed position to suit a relatively wide range of particular sheet material thicknesses handled.

In respect to the particular mounting arrangement and adjusting means (for guide member 28) shown here by example, it should be understood that other suitable conventional devices can be employed to function equally well. For instance, guide member 28 can be mounted in an angularly adjustable cantilever mechanism.

Figure 7:
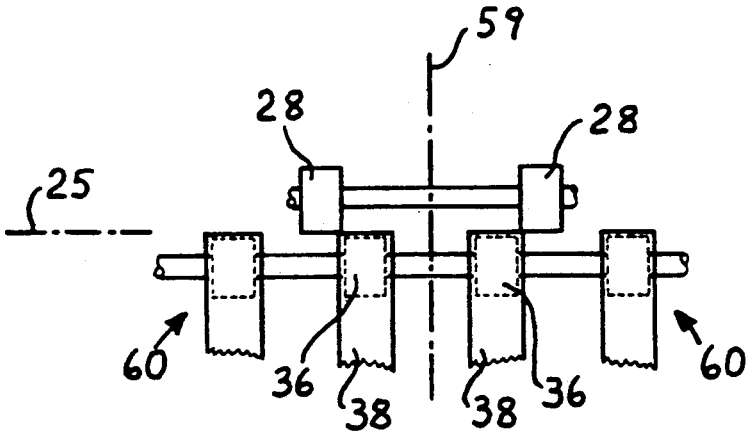
Figure 8:
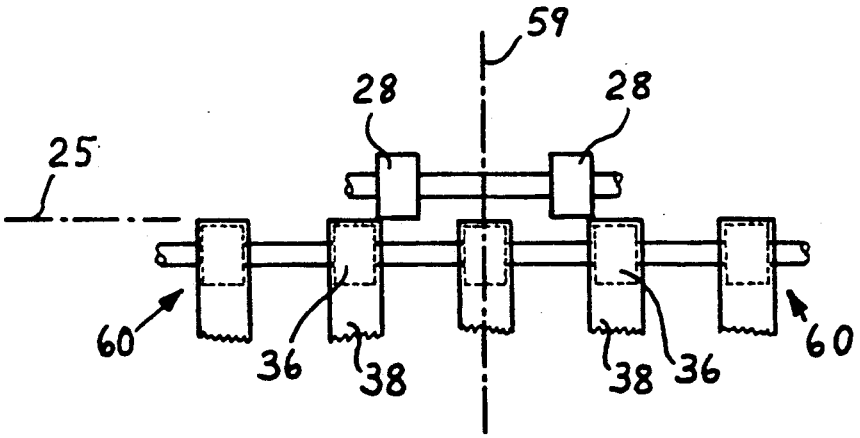

Referring now to FIGS. 7 and 8, two further examples of slightly differing embodiments to the ones discussed hereinbefore are illustrated. The differences will be appreciated particularly also in view of the depiction in FIG. 2.

FIG. 7 includes two support members 36 (each carrying a resilient member 38) and each of the two guide members 28 overlap the respectively therewith associated resilient member at a laterally opposite side. The arrangement is substantially symmetrical again about center plane 59. In other respects this arrangement is substantially identical to the embodiment depicted in FIG. 2. Particularly also FIG. 3 and the description given in conjunction therewith is similarly applicable to the embodiment of FIG. 7.

FIG. 8 also includes two support members 36 (each carrying a resilient member 38) and each of the two guide members 28 overlap the respectively therewith associated resilient member at a laterally opposite side (albeit different sides to the ones of FIG. 7). The arrangement is substantially symmetrical again about center plane 59. In other respects this arrangement is also substantially identical to the embodiment depicted in FIG. 2. Particularly also FIG. 3 and the description given in conjunction therewith is similarly also applicable to the embodiment of FIG. 8.

Although the depictions of FIGS. 7 and 8 show symmetrical arrangements (with respect to center line 59) of preferred embodiments, it should be understood that the arrangements' symmetry is adopted here for the sake of convenience, rather than to imply a structural limitation. It will be appreciated that an appropriate asymmetrical layout of the components can function equally well.

As the foregoing descriptions in conjunction with FIGS. 1-6 are applicable also to the depictions of FIGS. 78, no further discussion is offered here with respect to the latter.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A sheet material feeder for seriatim feeding of lowermost sheets from a sheet stack, said sheet material feeder comprising:

a sheet hopper for holding a stack of sheets, said sheet hopper having a singulating exit region, and means for urging sheets toward said singulating exit region;

a sheet feeding plane in which said lowermost sheet of the sheet stack is substantially disposed while being fed from the sheet stack in said sheet hopper;

a singulating plane through said singulating exit region and oriented substantially orthogonally to the direction in which said lowermost sheet is fed from the sheet stack;

means for feeding said lowermost sheets from said sheet hopper through said singulating plane;

at least one restraining set including first and second means for restraining mutually cooperatively all but the lowermost sheet of the sheet stack from feeding through said singulating plane, said first means for restraining including a restrainer having a stationary guide member, said guide member including an urging surface having an urging edge region on one side thereof, said urging surface including a first and a second portion, said first portion generally facing toward leading edges of lower sheets in the sheet stack, said second means for restraining including a support member and a resilient member supported thereon, said support member including a support surface having a supporting edge region on one side thereof, said support surface supporting said resilient member, said resilient member having an outer and an inner surface and a thickness therebetween, said inner surface including a contact surface region substantially contacting said support surface, said resilient member including a lateral overhang extending laterally beyond said supporting edge region, wherein said second portion of said urging surface faces said outer surface in the region of said lateral overhang;

a first plane substantially parallel to said sheet feeding plane and tangent to said urging surface at least in said urging edge region in the region of said singulating plane; and a second plane parallel to said first plane and tangent to said support surface at least in said supporting edge region in the region of said singulating plane;

wherein said first and second planes are spaced apart by a distance that is less than the sum of said thickness of said resilient member plus the smallest thickness of sheet material operatively handled by said sheet material feeder, and wherein said lowermost sheets are fed through said singulating plane between said urging edge region and said outer surface.

2. The sheet material feeder according to claim 1, wherein said resilient member is driven in the direction of sheet feed motion to frictionally engage the bottom face of said lowermost sheet and to transport said lowermost sheet upon said outer surface through said singulating plane.

3. The sheet material feeder according to claim 1, wherein said resilient member is an endless sleeve borne upon said support member.

4. The sheet material feeder according to claim 1, wherein said resilient member is an endless flat belt.

5. The sheet material feeder of claim 4, wherein said support member is a pulley carrying said endless flat belt upon at least the portion of its periphery disposed in said singulating exit region.

6. The sheet material feeder according to claim 1, wherein said urging surface has a generally convex shape.

7. The sheet material feeder according to claim 1, wherein said urging surface is part of a cylindrical surface.

8. The sheet material feeder according to claim 1, wherein said guide member is a stationary roller.

9. The sheet material feeder according to claim 1, wherein said restrainer includes means for mounting thereof, said means for mounting including means for adjusting the distance between said first and second planes

10. The sheet material feeder of claim 9, wherein said means for mounting further includes means for spring-loading said guide member toward said resilient member.

11. The sheet material feeder according to claim 1, wherein the distance said urging edge region extends transversely over said lateral overhang in said sheet feeding plane defines an overlap, said overlap being less than said lateral overhang.

12. The sheet material feeder of claim 11, wherein said lateral overhang is substantially no less than about one sixteenth of an inch.

13. The sheet material feeder according to claim 1, wherein a center plane is defined as an orthogonal plane with respect to said sheet feeding plane in feed direction of said lowermost sheet of the sheet stack, and wherein said sheet material feeder includes at least one restraining pair, said at least one restraining pair including two said restraining sets, said restraining sets of said restraining pair being disposed on either side of said center plane, and wherein one of said restraining sets is substantially a mirror-image of the other one.

14. The sheet material feeder according to claim 1, wherein said first and second means for restraining mutually cooperatively include means for resiliently corrugating at least a portion of said lowermost sheet transversely to the direction of sheet feeding and slightly out of said sheet feeding plane in the region of said singulating plane while said lowermost sheet is being fed therethrough.

15. A method of seriatim feeding of lowermost sheets from a sheet stack disposed in a hopper, comprising the steps of:

urging sheets toward a singulating exit region of said hopper; feeding feeding said lowermost sheets in a sheet plane, while said lowermost sheets are disposed in said hopper, toward a singulating plane that is disposed in said singulating exit region and that is oriented substantially orthogonally to the direction of sheet feeding in said sheet feeding plane;

restraining mutually cooperatively by first and second means for restraining all but the lowermost sheet of the sheet stack from feeding through said singulating plane, said first means for restraining including an urging surface having an urging edge region on one side thereof, said second means for restraining including a resilient member having an inner and an outer surface and a thickness therebetween and being supported on a support surface of a support member having a supporting edge region on one side thereof, said resilient member extending laterally beyond said supporting edge region by a lateral overhang, wherein a portion of said urging surface faces a portion of said outer surface and laterally overlaps a portion of said lateral overhang; and, through-feeding through said singulating plane said lowermost sheets in contact with and between said urging edge region and at least a portion of said outer surface in the region of said lateral overhang.

16. The method of seriatim feeding according to claim 15, wherein said steps of restraining and through-feeding include resiliently corrugating at least a portion of said lowermost sheet transversely to the direction of sheet feeding and slightly out of said sheet feeding plane in the region of said singulating plane, said step of resiliently corrugating being effected mutually cooperatively by said first and second means for restraining.

17. A sheet material feeder for seriatim feeding of lowermost sheets from a sheet stack, said sheet material feeder comprising:

a sheet hopper for holding a stack of sheets, said sheet hopper having a singulating exit region and feeding means for urging a lowermost sheet toward said singulating exit region;

a sheet feeding plane in which said lowermost sheet of said sheet stack is substantially disposed while being fed from said sheet stack;

restraining means for restraining all but the lowermost sheet of said sheet stack from feeding through said exit region, said restraining means including:

first and second surface means, said second surface means facing at least a portion of said feeding means in said exit region and forming a gap therebetween, said first surface means facing toward the leading edges of sheets of said stack of sheets;

a support member;

at least one resilient member supported by said support member;

said feeding means being operative to feed said lowermost sheet through said gap; and, said resilient means and said second surface means being mutually cooperative to bend said lowermost sheet relative to said sheet feeding plane as said lowermost sheet passes through said gap to thereby effect corrugation of said lowermost sheets as it passes through said exit region;

wherein said resilient member is wider than said support member thereby to have a lateral overhang portion thereof extending beyond the width of said support member.

18. The apparatus of claim 17 wherein said first and second surface means are stationary.

19. The apparatus of claim 17, wherein said second surface means is located adjacent said lateral overhang portion and spaced therefrom so that passage of said lowermost sheet through said gap causes said lowermost sheet and said lateral overhang to bend and result in said corrugation of said lowermost sheet.

20. The apparatus of claim 17 wherein said resilient member is an endless belt.

21. The apparatus of claim 20 wherein said support member is a pulley carrying said endless belt.

22. A sheet material feeder for seriatim feeding of lowermost sheets from a sheet stack, said sheet material feeder comprising:

a sheet hopper for holding a stack of sheets said sheet hopper having a singulating exit region and means for urging sheets toward said singulating exit region;

a sheet feeding plane in which said lowermost sheet of the sheet stack is substantially disposed while being fed from the sheet stack;

a singulating plane through said singulating exit region and oriented substantially orthogonally to the direction in which said lowermost sheet is fed from the sheet stack;

means for feeding said lowermost sheets through said singulating plane;

first and second restraining means for restraining all but the lowermost sheet of the sheet stack from feeding through said singulating plane;

said first restraining means including a guide member, said guide member including an urging surface having an urging edge region on one side thereof;

said urging surface including a first and a second portion, said first portion generally facing toward leading edges of lower sheets in the sheet stack;

said second restraining means including a support member and a resilient member supported thereon, said support member including a support surface having a supporting edge region on one side thereof and supporting said resilient member;

said resilient member having an outer and an inner surface and a thickness therebetween, said inner surface including a contact-surface region substantially contacting said support surface;

said resilient member including a lateral overhang extending laterally beyond said supporting edge region, wherein said second portion of said urging surface faces said outer surface in the region of said lateral overhang;

a first plane substantially parallel to said sheet feeding plane; and a second plane parallel to said first plane;

wherein said first and second planes are spaced apart by a distance that is less than the sum of said thickness of said resilient member plus the smallest thickness of sheet material operatively handled by said sheet material feeder, and wherein said lowermost sheets are fed through said singulating plane between said urging edge region and said outer surface.

23. A method of seriatim feeding of lowermost sheets from a stack of sheets in a sheet feeder of the type in which a support member has a resilient member mounted thereon so that an overhang portion of said resilient member overhangs the width of said support member and an urging means is located adjacent said overhang portion to form a gap therebetween that is offset from a sheet feeding plane at least when a sheet is moved between said urging means and said overhang portion, said method comprising the steps of:

locating the lowermost sheet of said stack in a sheet-feeding plane which extends through a singulating exit region and restraining all but the lowermost sheet of said sheet stack from feeding through said singulating exit region;

feeding said lowermost sheet from said hopper in said sheet feeding plane to move said lowermost sheet toward said singulating exit region and through said gap between said urging means and said overhang portion;

corrugating said lower sheet as a transverse portion of said sheet is fed through such offset gap and partly out of said sheet feeding plane while being moved through said singulating exit region.

* * * * *

UNITED STATES PATENT AND TRADEMARK OFFICE

CERTIFICATE OF CORRECTION

PATENT NO. : 5,110,107

DATED : May 5, 1992

INVENTOR(S) : Thomas E. Bieber

It is certified that error appears in the above-indentified patent and that said Letters Patent is hereby corrected as shown below:

On the Title Page, item [56] should read as follows:

References Cited

U.S. PATENT DOCUMENTS

| | | | |
|---|---|---|---|
| 4,059,262 | 11/1977 | FUJIMATO | 271/35 |
| 4,607,832 | 8/1986 | ABE | 271/10 |

FOREIGN PATENT DOCUMENTS

| | | | |
|---|---|---|---|
| 475,056 | 7/1951 | Canada | 271/272 |
| 1,127,193 | 7/1982 | Canada | Int. Cl. BH65H 3/02 |
| 74,777 | 2/1945 | Czechoslovakia | 271/272 |
| 3,018,513 | 11/1980 | Germany | Int. Cl. BH65H 3/52 |
| 6,900,533 | 7/1970 | The Netherlands | Int. Cl. BH65H 29/12 |
| 3,508,981 | 8/1986 | Germany | Int. Cl. BH65H 3/04 |

OTHER PRIOR ART

Xerox Disclosure Journal, "Sheet Feeding Method for Machines with Belt Transport," V.R. Green, Vol. 4, No. 1, January/February 1979.

Signed and Sealed this

Fifteenth Day of August, 1995

Bruce Lehman

*Attest:*

BRUCE LEHMAN

*Attesting Officer*

*Commissioner of Patents and Trademarks*